United States Patent [19]

Brothers

[11] 4,223,710

[45] Sep. 23, 1980

[54] STORING AND DISPENSING MEANS FOR HOSE AND THE LIKE

[76] Inventor: Jack Brothers, 806 Tuxedo Dr., Fort Walton Beach, Fla. 32548

[21] Appl. No.: 35,446

[22] Filed: May 3, 1979

[51] Int. Cl.[3] ..... B65D 85/675

[52] U.S. Cl. ..... 150/0.5; 248/89; 242/129; 150/49

[58] Field of Search ..... 150/0.5, 52 R, 48–49; 248/89–90; 242/129

[56] References Cited

U.S. PATENT DOCUMENTS

| | | | |
|---|---|---|---|
| 42,002 | 5/1864 | Patureau | 266/409 |
| 912,796 | 2/1909 | Boye | 242/129 |
| 943,202 | 12/1909 | Struss | 242/129 |
| 2,944,759 | 7/1960 | Donavan | 242/129 |

FOREIGN PATENT DOCUMENTS

| | | | |
|---|---|---|---|
| 973701 | 9/1950 | France | 242/129 |

*Primary Examiner*—Herbert F. Ross
*Attorney, Agent, or Firm*—Thomas N. Neiman

[57] ABSTRACT

In the embodiment shown, for exemplary purposes, the invention comprises a storing and dispensing container for hose, rope, wire and such filamentary material, formed of compliant, resilient platic. The container has an apertured base and an annular shell joined thereto, the end of the shell opposite the base having a plurality of limbs and webs. Each web has a tab-receiving slot formed therein latchingly to receive therein a tab formed in the end of a limb. Each of the limbs have the end tabs, and each thereof is received in slots provided therefor, to form a basket-weave-type of closure for the container.

8 Claims, 7 Drawing Figures

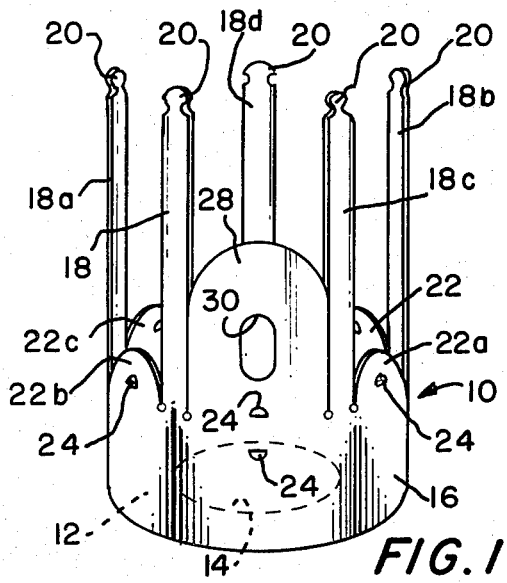
FIG. 1
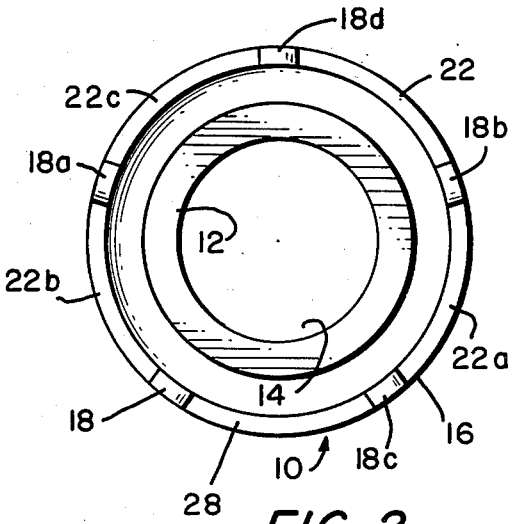
FIG. 2
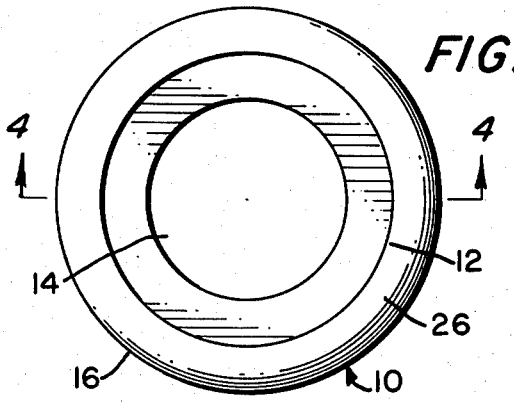
FIG. 3
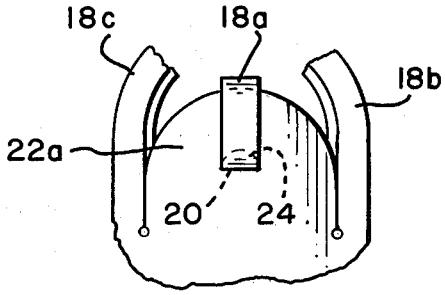
FIG. 5
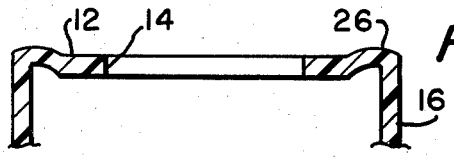
FIG. 4
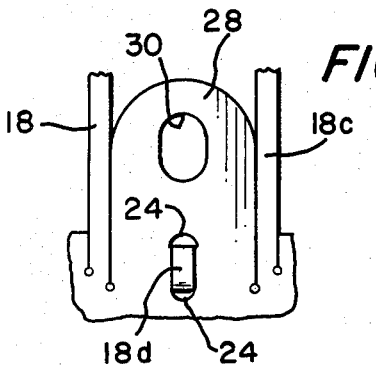
FIG. 6
FIG. 7
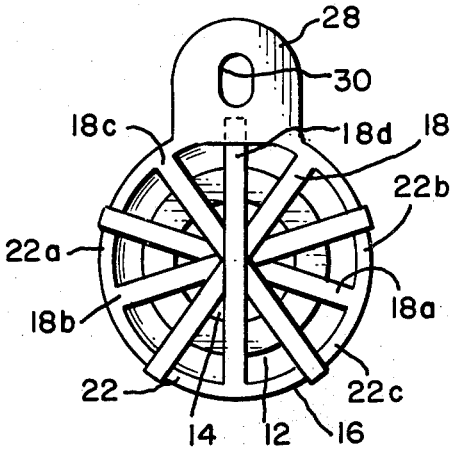

STORING AND DISPENSING MEANS FOR HOSE AND THE LIKE

This invention pertains to storing and dispensing means for hose, rope, wire, and like filamentary material, and in particular to an improved storing and dispensing means having a more solid and durable body, formed of a single, interlocked or latched structure.

The prior art for such storing and dispensing means is probably best exemplified by my own prior U.S. Pat. No. 3,384,140. Not unlike the instant invention, my prior invention however comprised a plurality of parts which had to be fastened together to define the article. Also, the prior article, particularly designed to serve as a hose storage device, was unduly compliant. It was somewhat lacking in structural integrity.

It is an object of this invention to set forth an improved storing and dispensing means. Particularly it is an object of this invention to teach a storing and dispensing means for hose, rope, wire, and like filamentary material, comprising an apertured base; and an annular wall or shell having first and second opposite ends; wherein said first of said opposite ends is integral with, and disposed normal to, said base; said second of said opposite ends has means defining a closure, disposed across said second end, which lies substantially parallel with said base; and said closure-defining means comprises a plurality of mutually-traversing limbs.

Further objects of this invention, as well as the novel features thereof, will become more apparent by reference to the following description taken in conjunction with the accompanying figures, in which:

FIG. 1 is an isometric projection of an embodiment of the invention;

FIG. 2 is a top view of the embodiment of FIG. 1;

FIG. 3 is a bottom view thereof;

FIG. 4 is a cross-sectional view of the base thereof, taken along section 4—4 of FIG. 3;

FIG. 5 is a fragmentary view of a portion of the embodiment depicting the manner in which a limb-end tab engages a tab-receiving opening in its respective web;

FIG. 6 is another fragmentary view depicting the engagement of one of the limbs, via the end tab thereof, with the hanger leaf; and FIG. 7 is another top view of the embodiment of the invention showing all the limbs replaceably latched in position, and the storing and dispensing means ready for use.

As shown in the Figures, the novel storing and dispensing means 10, according to an exemplary embodiment thereof, comprises a base 12 in which there is formed a central aperture 14. A shell 16, integrally joined to the base 12 at one end, has a plurality of limbs 18, 18*a*, 18*b*, 18*c*, and 18*d* extending from the opposite end thereof. The limbs 18–18*c* are equally spaced apart, peripherally of the shell 16, and each has a tab 20 formed at the end thereof.

Between the pairs of limbs, and also extending from the shell 16, are webs 22, 22*a*, 22*b*, and 22*c*. Each of the webs has a tab-receiving opening 24 formed therein in which replaceably to receive a tab 20 of one of the limb ends.

The base 12 has a circular rib 26, of arcuate cross-section, which both rigidizes the base itself, and the whole storing and dispensing means 10 as well. The limbs 18–18*c* are each latched with a respective web 22–22*c*.

Specifically, limb 18 is latched with the web which is diametrically opposite: 22. Limb 18*a* is latched with its opposite web 22*a*; limb 18*b* is latched across with web 22*b*; and limb 18*c* is latched with its respective, opposite web 22*c*.

As shown in FIG. 5, by way of example, in connection with limb 18*a* and web 22*a*, the limb tab 20 is passed into the opening 24 from outside of the shell —to dispose the tab 20 within the shell. Thus, the limb 18*a* overlies the terminal end of the web 22*a*, to draw it into position (substantially parallel with the base 12) and the tab 20 is confined within; hence, when all the limbs and webs are made fast together, the basket-weave-type closure thus formed has substantially no protrusions.

Thus far, the embodiment 10 comprises means admirably suited and configured for storage and dispensing of hose, rope, wire, and the like. However, to add further utility, means are provided for hanging the means 10 in elevation.

Between limbs 18 and 18*c*, extending from the shell 16, is an elongate leaf 28 which has a hanger hole 30 formed therein. The hole is used to suspend the embodiment 10 from an outdoor faucet, or post, or the like. Leaf 28 also has a pair of openings 24 the topmost one of which passes therethrough an intermediate portion of limb 18*d*. The tab 20 of limb 18*d* is further passed into the lowermost opening 24 to latch thereat.

The novel storing and dispensing means 10, according to the embodiment depicted, is formed of compliant, resilient plastic of approximately one-eighth-inch thickness (approx. 3.25 m.m.), which gives the inventive article a considerable durability. Also, as noted priorly, the arcuate base rib 26, lends an uncommon rigidity or hoop strength to the means 10. The formation of the inventive article from a single piece of plastic stock greatly simplifies its use, and the cross-latched limbs 18–18*d* comprise strengthening struts or trusses which aid in retaining the life of the article and its "assembled" shape in spite of rough handling.

While I have described my invention in connection with a specific embodiment thereof, it is to be clearly understood that this is done only by way of example and not as a limitation to the scope of the invention, as set forth in the objects thereof and in the appended claims.

I claim:

1. Storing and dispensing means for hose, rope, wire, and like filamentary material, comprising:

an apertured base; and an annular shell having first and second opposite ends; wherein said first of said opposite ends is integral with, and disposed normal to, said base;

said second of said opposite ends has means defining a closure, disposed across said second end, which lies substantially parallel with said base; and said closure-defining means comprises a plurality of mutually-traversing limbs; wherein said limbs have latching means formed at ends thereof;

said shell has means for engagingly securing said limb-end latching means;

said limb-end latching means are engageably secured by said securing means;

said second end further has a plurality of webs;

said limb-end latching means comprise tabs formed at the ends of said limbs; and each of said webs has a tab-receiving opening formed therein which replaceably latches one of said tabs therewithin.

2. Storing and dispensing means, according to claim 1, wherein:

each of said webs has a pair of said limbs adjacent thereto, one limb of said pair being at one side of its respective web and the other thereof being at the opposite side thereof; and each of said webs has a limb diametrically opposite thereto.

3. Storing and dispensing means, according to claim 2, wherein:

each of said webs receives and replaceably latches, in said tab-receiving opening therein, said limb-end tab of the limb diametrically opposite thereto.

4. Storing and dispensing means, according to claim 2, wherein:

said base, shell, and limbs are formed of compliant, resilient plastic; and stress-relief, arcuate cut-outs are formed between each of said webs and said pairs of limbs adjacent thereto.

5. Storing and dispensing means, according to claim 1, wherein:

said latched tabs and webs define a basket-weave-type of closure at said second end;

intermediate portions of each limb overlying an end of the web with which is is replaceably latched; and said tabs of each of said limbs being passed through the opening of the web within which it is replaceably latched, to lie exposed within said storing and dispensing means, whereby all web ends and limb-end tabs latched with said webs cooperate to define said second end substantially devoid of protrusions.

6. Storing and dispensing means, according to claim 3, wherein:

said base has a circular rib, arcuate in cross-section, for rigidizing said base and said storing and dispensing means.

7. Storing and dispensing means, according to claim 3, further including:

hanger means, integral with said second end of said shell, for hanging said storing and dispensing means in elevation.

8. Storing and dispensing means, according to claim 7, wherein:

said hanger means comprises an elongate leaf;

said leaf has a pair of tab-receiving openings formed therein;

said limbs have latching tabs formed at the ends thereof; and said limb-end tab of one of said limbs is passed through one of said openings and is replaceably latched in the other opening.

* * * * *